US005460378A

United States Patent [19]

Getts

[11] Patent Number: 5,460,378

[45] Date of Patent: Oct. 24, 1995

[54] GOLF CLUB COUNTERWEIGHT

[76] Inventor: Wayne A. Getts, 2730 Bomkamp Cir., Sun Prairie, Wis. 53590

[21] Appl. No.: 357,453

[22] Filed: Dec. 16, 1994

[51] Int. Cl.[6] ..... A63B 69/36

[52] U.S. Cl. ..... 273/194 B; 273/81 D; 273/186.1; 273/186.2

[58] Field of Search ..... 273/194 B, 194 R, 273/193 R, 165, 81 D, 186.2, 162 R, 26 B, 194 B

[56] References Cited

U.S. PATENT DOCUMENTS

| | | | |
|---|---|---|---|
| 2,135,648 | 11/1938 | Stumpf | 273/194 B |
| 3,136,546 | 6/1964 | Connolly . | |
| 4,364,560 | 12/1982 | Gemmel | 273/194 B |
| 4,588,191 | 5/1986 | Stewart | 273/194 B |
| 4,819,942 | 4/1989 | Lee et al. | 273/194 R |
| 5,228,688 | 7/1993 | Davis . | |
| 5,308,072 | 5/1994 | Pettinelli et al. . | |

*Primary Examiner*—V. Millin
*Assistant Examiner*—Charles W. Anderson
*Attorney, Agent, or Firm*—DeWitt Ross & Stevens

[57] ABSTRACT

A golf club counterweight for releasible attachment to, and relocation upon, a golf club shaft is formed by a weight member having a shaft aperture sized to accommodate the shaft of a golf club. Friction means are provided within the weight member so that it may be relocated upon the shaft as the golfer desires. By attachment and relocation upon the shaft, the counterweight affects the weight distribution of the golf club by increasing/decreasing the golf club mass near the golf club head, and thus changes the swing weight of the golf club. The golfer may thus adapt the swing weight of the golf club to account for variations in golf course conditions and in the golfer's personal preferences in the feel and handling of the golf club.

22 Claims, 5 Drawing Sheets

GOLF CLUB COUNTERWEIGHT

FIELD OF THE INVENTION

The invention pertains generally to the field of apparatus for enhancing the performance of golf clubs, and particularly to counterweights for enhancing the performance of a putter by modifying its swing weight.

BACKGROUND OF THE INVENTION

Many a devotee of the fine art of golfing has searched for years for the perfect golf club or set of golf clubs, the one which will radically enhance golf scores and catapult the player into tournament play. Such a club would adapt to the changing conditions of the golf course and the golfer's varying preferences in the "feel" and "handling" of the golf club to allow a perfect stroke every time. Unfortunately, despite years of research and development, no golfer or golf equipment company has yet been able to develop this "magic" club. Nevertheless, the prior art does reveal some advances in club design, specifically in designs which modify the golf club's swing weight, which have helped to enhance many a golfer's score. The swing weight of a golf club, a measurement of the golf club's "feel" as it is swung, is one of its most important performance characteristics.

The prior art contains examples of golf clubs and additions to golf clubs specifically directed towards altering the golf club's swing weight. For example, U.S. Pat. No. 5,228,688 to Davis discloses a set of golf clubs having a matching swing weight. The golf clubs include counterweights secured near their handles with the weights specifically chosen so that the same swing weight is obtained for all clubs. Each golf club within the set also has a uniquely angled head and a grip which is meant to be grasped only at a certain area. The head angles and grip points of all clubs are such that their height is the same for any swing. With the swing weight, club height, and club head modified as shown by Davis, all clubs within the set have both a uniform "feel" and a uniform look as they are swung.

U.S. Pat. No. 5,308,072 to Pettinelli et al. is directed to a counterweight or multiple counterweights attached to the handle of a golf club by means of a member having two legs attached together so that the member has a "J" shape. The leg of the member that is not affixed to the handle is threaded and bears one or more counterweights, which may be positioned at different areas along the leg by adjusting them along the threads. The angle of this leg may be adjusted by the use of a pivot located at the junction between the legs. The counterweight thus serves to shift the weight distribution of the club towards the handle and away from the club head, and more importantly, towards the golfer. The counterweight is positioned so that the golfer's hands serve as the fulcrum point of the club's weight distribution. Thus, while the club is made heavier overall by the addition of the counterweights, the club head itself feels "weightless", allowing a steadier and more precise stroke.

While the club modifications of Davis and Pettinelli, et al. modify the swing weight of a golf club, they tend to have drawbacks.

First, clubs such as those of Davis can generally only be obtained by buying an entirely new set of clubs, since retrofitting the invention of Davis into an existing set of clubs is a daunting task.

Second, the golf clubs and modifications of Davis and

Pettinelli et al. may not be allowable in tournament play, since tournament regulations generally disallow golf clubs having permanently attached modifications.

Third, the inventions of Davis and Pettinelli et al. respectively have the goals of achieving a fixed and uniform swing weight for all clubs within a set, and achieving a club with an extremely low or practically nonexistent swing weight. On the other hand, it is believed that golfing scores are more rapidly and greatly improved not by fixing, reducing, or making uniform the swing weight of a golf club, but rather by selectively altering the swing weight of the golf club to better match the conditions of the course and the preferences of the user. Further, it is believed that better results in swing weight modification can be achieved by altering the weight of the golf club's shaft near the head, rather than the handle.

SUMMARY OF THE INVENTION

The present invention is directed to a golf club counterweight apparatus which may be retrofit upon the shaft of a golf club, more specifically a putter, and slidably located at different points thereon to alter the swing weight of the golf club as the golfer desires and as golf course conditions demand.

The counterweight apparatus of the present invention is intended to selectively modify the swing weight of a golf club having a shaft with a handle end and a head end, with the handle end including a handle and the head end including a head. The counterweight apparatus comprises a weight member including an outer surface, an inner surface defining a shaft aperture adapted for the shaft to fit therein, and two opposing rims bounding the inner surface and the outer surface. The inner surface includes friction means for releasibly adhering the inner surface to the shaft of a golf club.

The counterweight apparatus of the present invention may also comprise two member sections, with each member section having an outer surface and also an inner surface which bounds the outer surface and which is contoured to receive at least a portion of the shaft in a complementary manner. Each member section includes fixture means for attaching to the other member section. The member sections are adapted so that the inner surfaces of both member sections may simultaneously receive at least a portion of the shaft of the golf club when the fixture means are engaged. The inner surface of at least one member section includes friction means for slidably engaging the shaft.

For example, a morning round of golf may be played on a wet course. This can make a critical difference in the performance of a putter on the green, since the wet green will make for a "slow" putt. By slidably locating the counterweight near the head of the putter, the swing weight of the putter will be altered so that the golfer feels more weight near the head. The heavier feel allows the golfer to putt in the manner he desires. Thus, the golfer will not need to swing faster in order to defeat the wet, sticky grass and make his putt. As another example, a drier afternoon green will be "faster." The counterweight may be moved up from the head to decrease the club's mass concentration near the head and adjust the swing weight as desired. The golfer then does not need to swing slower to adapt to the dry and fast green. The golfer may thus modify the swing weight so that the weight distribution of the club has the proper feel for the conditions of the course or the golfer's preference on that day. The golfer can even alter the swing weight on every stroke if desired.

Further, the counterweight of the present invention may be retrofit on an existing golf club without permanently attaching the counterweight to the golf club. This is of great benefit because it may therefore qualify for tournament use where the tournament regulations otherwise ban modifications to the golf club which are in the form of permanent attachments. Thus, the golfer need not worry about reaching tournament play with the assistance of the counterweight, only to be barred from using the counterweight in the tournament itself.

Further objects, features, and advantages of the invention will be apparent from the following detailed description when taken in conjunction with the accompanying drawings.

DETAILED DESCRIPTION OF THE INVENTION

Figure 1:
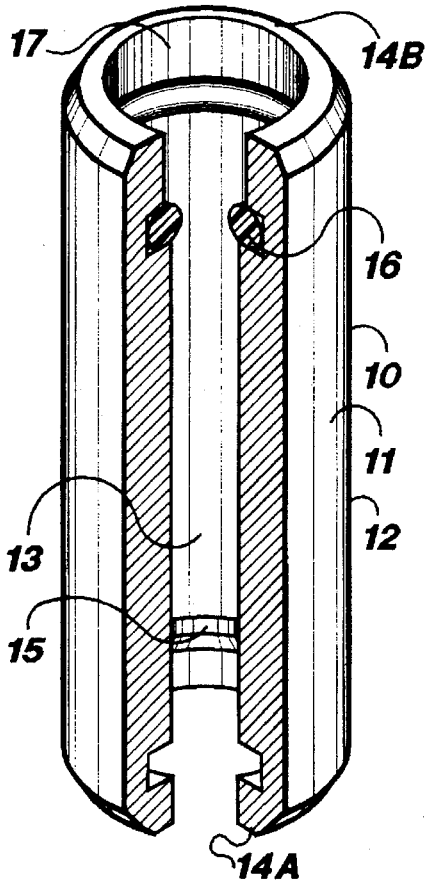
FIG. 1 is a side elevated view of a golf club with the counterweight of FIG. 2 installed on the shaft.

With reference to the drawings, wherein the same or similar features are denoted by the same reference numbers, the counterweight of the present invention is shown in FIG. 1 installed on a golf club 50, specifically a putter, at 10. While the counterweight 10 may be used on a variety of golf clubs, the following discussion will generally make reference to its use on a putter.

Figure 2:
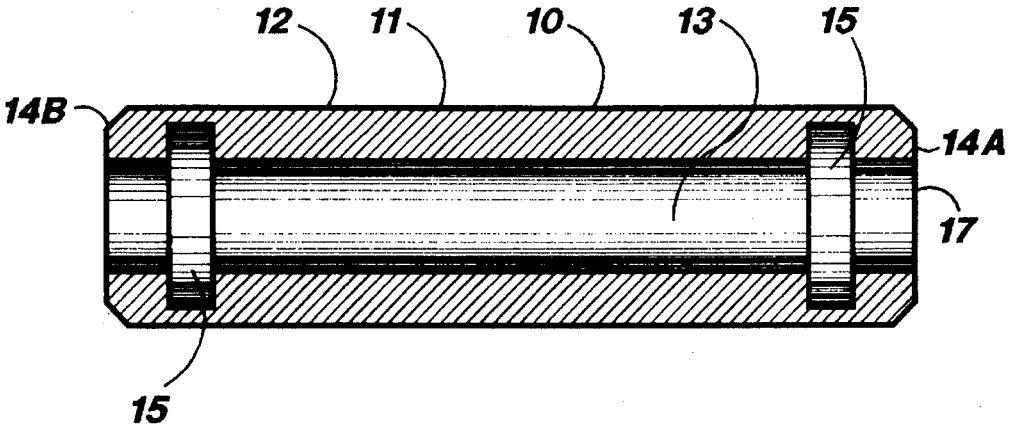
FIG. 2 is a perspective view of the counterweight of the present invention, with a section cut away to reveal the inner surface of the counterweight.
Figure 3:
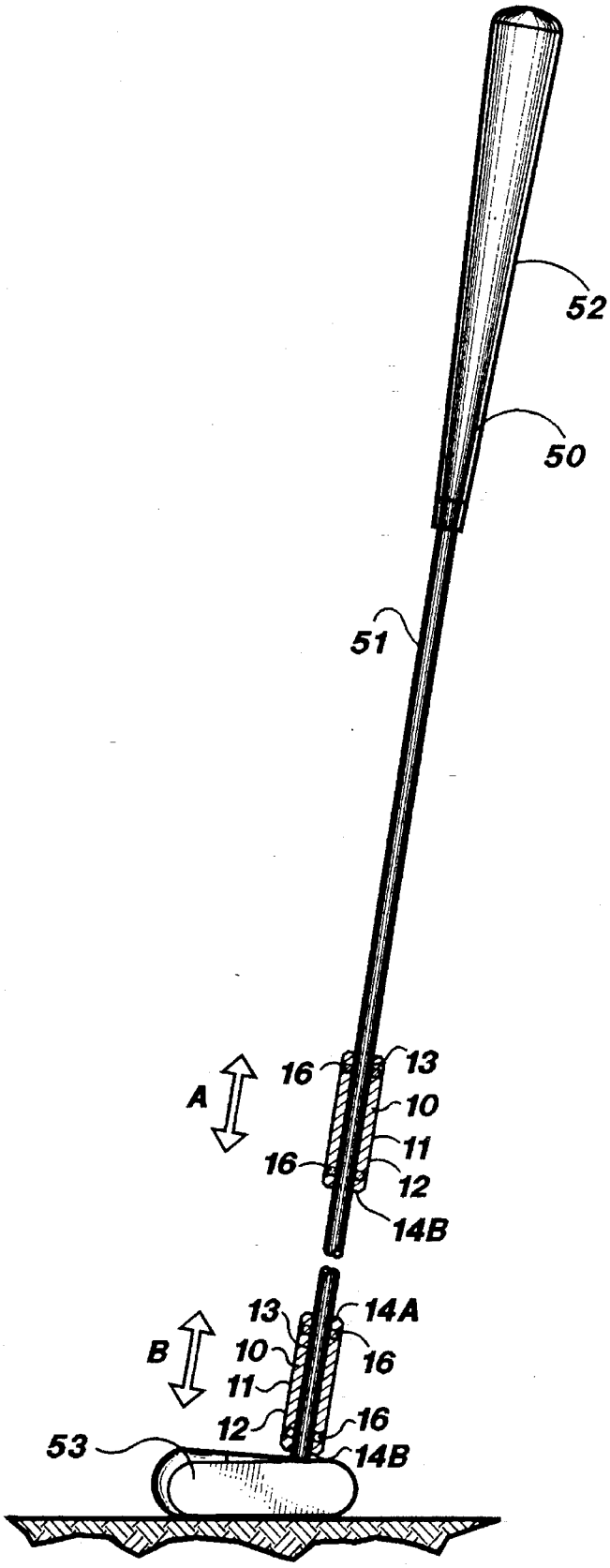
FIG. 3 is a side cross-sectional view of the counterweight of FIG. 2 taken along lines 3—3 of FIG. 2.

FIGS. 1, 2 and 3 show the preferred embodiment of the counterweight 10 of the present invention. The counterweight 10 includes a weight member 11 with an outer surface 12, an inner surface 13 which bounds a shaft aperture 17, and opposing rims 14A and 14B. As illustrated in FIG. 1, the shaft aperture 17 is sized to accommodate the shaft 51 of the golf club 50, which also includes a handle 52 attached at one end and a head 53 at the other. The weight member 11 may be constructed of any material which has sufficient mass that the weight member 11 has a noticeable effect on the weight distribution of the golf club 50 when placed on the shaft 51. The preferred embodiment of the counterweight 10 is made of steel and has a weight of approximately 2 ounces.

The weight member 11 preferably includes friction means for adhering to the shaft 51 so that the counterweight 10 will only move on the shaft 51 when manually relocated by the golfer. As shown in FIGS. 2 and 3, this friction means may comprise two rubber friction rings 16 which are each located in slots 15 on the inner surface 13 of the weight member 11. In FIG. 2, only one friction ring 16 is shown, with one slot 15 empty; in FIG. 3, both friction rings 16 are removed to show the empty slots 15. Each slot 15 is located adjacent to one of the rims 14A and 14B, allowing the friction rings 16 to be easily installed within the slots 15 by inserting the friction rings 16 within the shaft aperture 17 at each rim 14A and 14B. The shaft 51 rests within the shaft aperture 17 and within the friction rings 16. When the weight member 11 is relocated on the shaft 51, the circular cross-section of the rubber friction rings 16 rolls along the shaft 51, allowing the weight member 11 to translate smoothly upon the shaft 51. The circular cross-sections of the rubber friction rings 16 allow easy movement of the weight member 11 upon the shaft 51, yet prevent it from sliding on the shaft 51 so easily that it will self-relocate when the golf club 50 is swung.

Other embodiments of the counterweight 10 besides that shown in FIGS. 1–3 are possible. Initially, it is possible to devise a counterweight 10 with adjustable friction means which can be adapted so that they adhere to a greater or lesser extent to the shaft 51. Such adjustable friction means are desirable where the counterweight is to be used on different golf clubs 50. Since golf clubs 50 used for long-range driving are generally swung with greater force than a putter, the friction means must adhere the weight member 11 to the shaft to a greater extent or the centrifugal force caused by a strong swing would move the counterweight 10 towards the head 53. Thus, it would be advantageous if the counterweight 10 could adjust its friction means so that the same counterweight 10 could be used on different golf clubs 50 with different swing forces. Embodiments of counterweights using adjustable friction means are shown in FIGS. 4–6.

Figure 4:
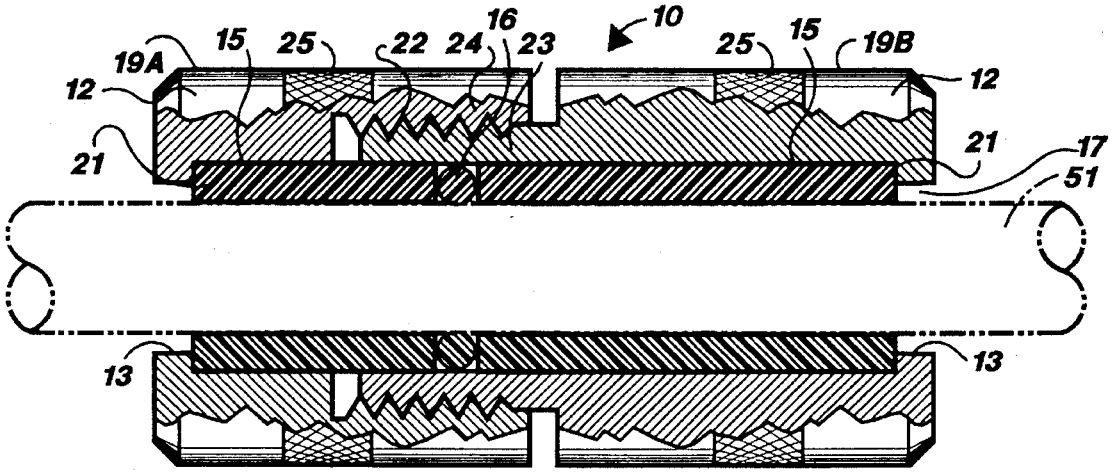
FIG. 4 is a partial side elevated view of a first alternate embodiment of the counterweight of the present invention.

FIG. 4 shows a first alternate embodiment of the counterweight 10 including two member sections 19A and 19B. Each member section 19 includes an inner surface 13 bounding a central aperture 17 which accommodates the shaft 51. Each inner surface 13 includes a slot 15 wherein friction means may rest. The friction means of the embodiment of FIG. 4 are in the form of both a rubber friction ring 16 and two teflon sleeves 21. Each member section 19 also includes fixture means by which one member section 19A may be attached to the other member section 19B. These fixture means apply a compressive force to at least one of the member sections 19A or 19B, thereby pressing its friction means against the shaft 51 and increasing the frictional force that anchors the member sections 19 to the shaft 51. In FIG. 4, the fixture means take the form of threading 22 located on a male portion 23 of member section 19A and on a female portion 24 of member section 19B. When the male portion 23 is threaded within the female portion 24, the male portion 23 is compressed, thereby pushing the friction ring 16 into tighter contact with the shaft 51. This increases its friction with respect to the shaft 51 and also tends to flatten its circular cross-section, making it more difficult to roll along the shaft 51. The sleeves 21 are also pushed into tighter contact with the shaft, but do not adhere to the shaft 51 to a significant degree due to their lower coefficient of friction. The sleeves 21 therefore mainly help the counterweight 10 slide along the shaft 51, while the friction ring 16 mainly provides adherence to the shaft.

Figure 5:
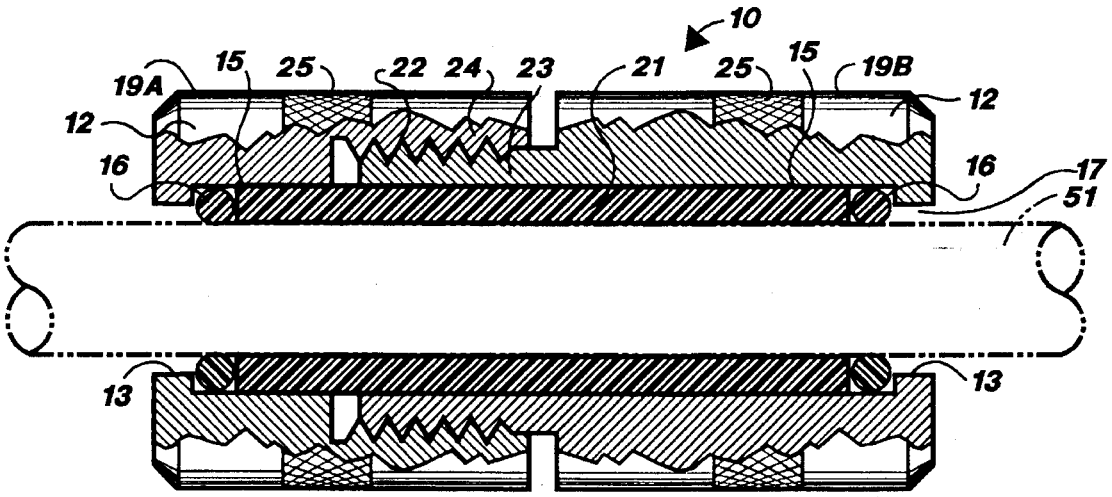
FIG. 5 is a partial side elevated view of a second alternate embodiment of the counterweight of the present invention.
Figure 6:
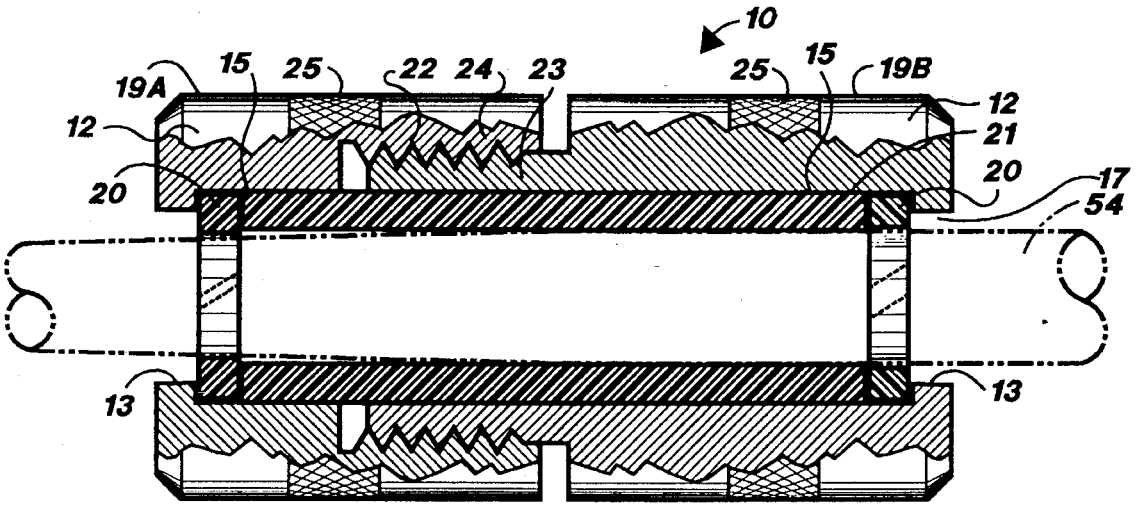
FIG. 6 is a partial side elevated view of a third alternate embodiment of the counterweight of the present invention.

It should be noted that when friction rings 16 are used in the counterweight as shown in FIGS. 4–6, the male 23/female 24 fixture means increase the friction of the inner surface 13 of the counterweight 10 at all points along the inner surface 13, rather than just those points adjacent the male portion 23. This is because the sleeves 21 and friction ring 16 are compressed in the axial direction when the male portion 23 is threaded within the female portion 24. This causes elastic friction rings 16 and sleeves 21 to expand in the radial direction, reducing their inner diameters so that the shaft 51 is more tightly gripped.

In order to adjust the friction means of the counterweight 10 for use on different clubs 50 and compensate for their corresponding swing forces, the golfer merely threads or unthreads the member section 19B into the member section 19A to achieve the desired amount of adherence of the counterweight 10 to the shaft 51. The counterweight of FIG. 4 may thus be used with all clubs 50, regardless of the force with which they are swung, by merely adjusting its friction means. Additionally, the outer surface 12 of the counterweight 10 may include knurling 25 to aid the golfer in tightening the member sections 19A and 19B together.

FIG. 5 shows a second alternate embodiment of the counterweight 10. This embodiment is similar to that of FIG. 4, but different friction means is used. A nylon sleeve 21 is provided within the slot 15 adjacent the threading 22 on the male portion 23 of member section 19A and the female portion 24 of member section 19B. When the member sections 19A and 19B are threaded together, the sleeve 21 is compressed, thereby increasing its adherence to the shaft 51. Two rubber friction rings 16 are included within the slots 15 at opposite sides of the sleeve 21 to provide additional adherence to the shaft 51, and also to provide the counterweight 10 with a rolling effect as it is moved on the shaft 51. The counterweight 10 shown in FIG. 5 is more difficult to slide on the shaft 51 than the counterweight 10 of FIG. 4, and is preferable for golfers who intend to use the counterweight mainly on medium-range driver clubs 50 which are swung with medium force. Its friction means may then be adapted for lower or higher adherence when the golfer wishes to use the counterweight 10 on clubs 50 which are swung with lighter or heavier force.

FIG. 6 shows a third alternate embodiment of the counterweight 10 whose adjustable friction means provide even greater adherence to the shaft. The counterweight 10 is similar to that of FIGS. 4 and 5, but it includes a polyethylene sleeve 21 and two split square rings 20 made of rubber. The member sections 19A and 19B may be threaded further together to increase the adherence of the sleeve 21 to the shaft 51. Because the square rings 20 cannot roll on the shaft 51, they significantly increase the difficulty with which the counterweight 10 may slide along the shaft 51. Such a counterweight may be preferred by golfers who plan to use the counterweight 10 mainly on long-range drivers. The member sections 19A and 19B may then be unthreaded to provide lower shaft 51 adherence for clubs 50 that are more lightly swung.

In summary, FIGS. 4–6 show that a variety of friction means may be used with the counterweight 10. The counterweight 10 may use multiple friction rings 16 having circular cross-sections such as the friction ring 16 shown in FIG. 1, square cross-sections such as the square ring 20 shown in FIG. 6, and rectangular cross-sections such as the sleeves 21 illustrated in FIGS. 4–6. Friction rings 16 having cross-sections of other shapes are also possible and are considered to be within the scope of this invention. The friction rings 16 may be made of elastic or inelastic substances with the desired frictional properties. For example, the friction rings 16 may be made of an elastic substance having a generally high coefficient of friction, such as rubber, or an inelastic substance having a generally low coefficient of friction, such as teflon. Friction rings 16 made of lead or other metals are also possible; lead, for example, provides extra weight to the counterweight 10 and additionally has a relatively low coefficient of friction. Friction rings 16 of different shapes, cross-sections, and materials may be combined to achieve the desired frictional properties for the friction means.

Additionally, FIGS. 4–6 also show that the friction means may be adjustable so that its adherence to the shaft 51 may be altered to fit any magnitude of swing force. This adjustable friction means is easily achieved by means of threading 22 on the male portion 23 of member section 19A and the female portion 24 of member section 19B. The female portion 24 may be tapered along its depth, becoming narrower as the male portion 23 is threaded further within, so that the compression of the male portion 23 (and thus its adherence to the shaft 51) is increased. Additionally, threading the male and female portions 23 and 24 together reduces the overall length of the counterweight 10, thereby axially compressing friction rings 16, sleeves 21, and square rings 20 and decreasing their inner diameters. The male portion 23 may contain one or more slots or cutout portions along its length so that it is not adversely stressed as it becomes compressed.

Finally, the friction means may also take the form of any other means for resisting the motion of the weight member 11 on the shaft 51. This can include any means by which the weight member 11 adheres to the shaft (e.g. by the use of a magnetic weight member 11) or any means by which the weight member 11 is actually attached to the shaft. However, under some tournament regulations, actual attachment to the shaft 51 may disallow the use of the counterweight 10 in tournament play.

Embodiments of the counterweight 10 may also be devised wherein the friction means adapt for irregularly-shaped shafts 51. For example, some golf clubs 50 have tapered shafts 54, which can cause difficulties in adherence to the shaft 54 for the counterweights 10 discussed above. This problem is easily surpassed by utilizing elastic split friction rings 16 which have an inner diameter which is approximately the same size as, or smaller than, the minimum outer diameter of the shaft 54. The apertures of such friction rings 21 may then expand to accommodate portions of the shaft 54 with wider diameter or contract to accommodate the narrower portions of the shaft 54. FIG. 6 shows an embodiment of the counterweight 10 utilizing a split square friction ring 20. As the counterweight 10 is slid up or down the shaft 54, the split square friction rings 20 can automatically expand and contract to match the variation in shaft 54 diameter. Additionally (or alternatively), the sleeve 21 may have an inner diameter greater than the maximum outer diameter of the shaft 54. The tightness of the split square friction rings 20 and the sleeve 21 about the shaft 54 may then be adjusted by threading the member sections 19A and 19B together or apart. Yet another alternative is that the sleeve 21 may have an inner diameter smaller than the minimum outer diameter of the shaft 54, and the sleeve 21 may automatically adjust itself for tightness by providing the sleeve 21 with a slit along its length. Split friction rings 16 of the square ring 20, sleeve 21, and other cross-sectional types are considered to be within the scope of this invention.

Figure 7:
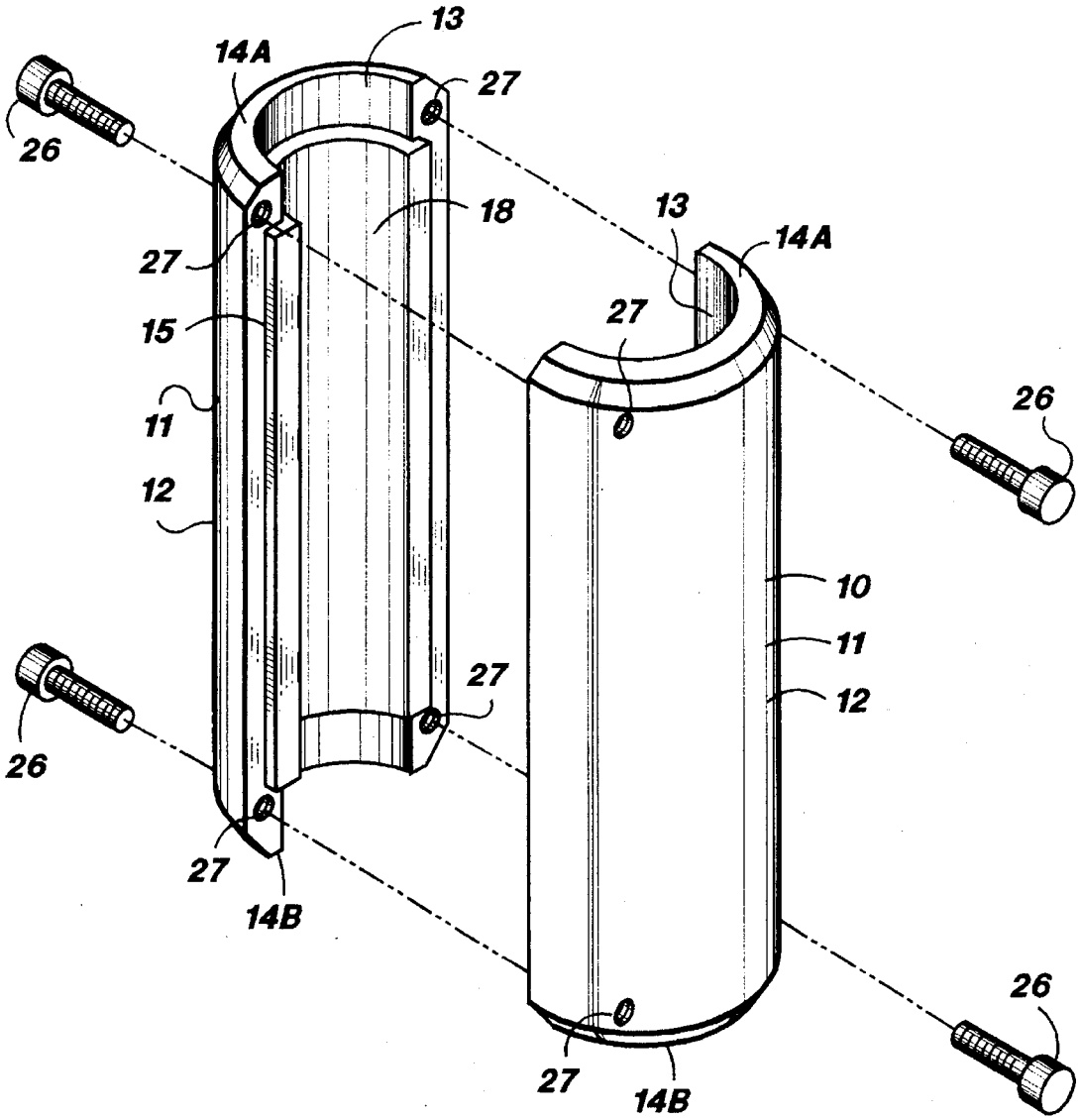
FIG. 7 is an exploded perspective view of a fourth alternate embodiment of the counterweight of the present invention.

A final embodiment of the counterweight 10 is designed for easy retrofit installation on a golf club 50, wherein the head 53 or handle 52 of the golf club 50 need not be removed to install the counterweight 10. This counterweight 10 is shown in FIG. 7. The weight member 11 is split into two member sections 28A and 28B which are adapted to fit in axial alignment about the shaft 51. The member sections 28A and 28B may be affixed about the shaft 51 by the use of fixture means such as the thumbscrews 26 and threaded apertures 27 shown in FIG. 7. The friction means may include two half sleeves 18, each of which rests within a slot 15 on the inner surface 13 of each member section 28A and 28B. Each slot 15 can retain its respective half sleeve 18 when the member sections 28A and 28B are removed from the shaft 51, thereby preventing the half sleeves 18 from falling out of the member sections 28A and 28B and becoming lost.

The half sleeves 18 of FIG. 7 provide adjustable friction means of the type that can adapt to different golf club 50 swing forces. When the member sections 28A and 28B are affixed about the shaft 51, the half sleeves 18 prevent them from making contact. This allows the member sections 28A and 28B to push the half sleeves 18 more tightly against the shaft 51 the more the thumbscrews 26 are tightened. The counterweight 10 of FIG. 7 thus includes adjustable friction means and so may be fit on any golf club 50 regardless of the force with which it is swung. At the same time, this embodiment of the counterweight 10 does not require disassembly of the golf club 50 for its installation.

Various modifications may be made to the counterweight 10 of FIG. 7 to attain various additional advantages.

First, the counterweight 10 can have one member section 28A made of a heavy material, such as metal, and the other member section 28B made of a material with a high coefficient of friction. The member section 28A therefore functions to alter the mass distribution of the shaft 51, while the member section 28B functions as friction means for adhering the counterweight 10 to the shaft 51.

Second, the counterweight 10 may use other fixture means besides the thumbscrews 26 and apertures 27 to fasten the member sections 28A and 28B together. Some possible alternative fixture means are pegs, clasps, magnetic surfaces, elastic bands, etc. Such alternative fixture means are considered to be within the scope of the present invention.

Third, as with all counterweights 10 discussed above, the counterweight 10 and its friction means may be made of different materials in different sizes and configurations. The counterweight 10 may be made of steel, lead, plastic with metal inserts, or any other suitably heavy material. The friction means may take the form of friction rings 16, square rings 20, sleeves 21, or other forms, and may be made of rubber, polyethylene, nylon, teflon, or other materials depending on the frictional characteristics desired for the counterweight 10.

The use of the counterweight 10 is outlined as follows. The preferred embodiment of the counterweight 10, which is shown in FIGS. 1–3, is installed on the golf club 50 by inserting the shaft 51 within the friction rings 16 and the shaft aperture 17. The shaft aperture 17 of the weight member 11 is sized so that the shaft 51 of the golf club 50 may fit within the shaft aperture 17 of the inner surface 13 and rest closely parallel thereto. To retrofit the counterweight 10 onto the golf club 50, the handle 52 or the head 53 of the golf club 50 may be removed so that the shaft 51 may be inserted within the shaft aperture 17 of the weight member 11. Thus, the counterweight 10 may be retrofit to almost any standard golf club 50. Since it is not permanently or intrusively attached to the club 50, it is allowable in tournament play.

After the counterweight 10 is mounted on the shaft 51, it may then be used to increase the swing weight of the club 50 as the golfer desires. The counterweight 10 is generally used at a position near the head 53, as shown in FIG. 1. The golfer moves the counterweight 10 by pushing or pulling the weight member 11 up or down the length of the shaft 51. FIG. 1 illustrates the counterweight 10 at a position A and a position B. Positions nearer the head 53, such as position B, produce a heavier feel in the head of the club 50 and allow the golfer to make shots on a "slow" course (e.g. a wet course or an unkempt course with taller grass) without having to swing the golf club 50 faster. Similarly, positions further from the head 53 (such as position A) produce a lighter feel, and are appropriate at "faster" areas of the course. The golfer may use the counterweight 10 to adapt the golf club 50 to course conditions (wetness, slope, grass condition, wind, etc.) or to match the golfer's personal preference at the moment. The golfer may install (or the golf club 50 may include) indicia along the shaft 51 which allow the golfer to determine and remember his favorite locations along the shaft 51 at which the counterweight 10 is placed.

It is understood that the invention is not confined to the particular construction and arrangement of parts herein illustrated and described, but embraces such modified forms thereof as come within the scope of the following claims.

What is claimed is:

1. A golf club counterweight apparatus for selectively modifying the swing weight of a golf club having a shaft with a handle end and a head end, with the handle end including a handle and the head end including a head, the apparatus comprising a weight member including an outer surface and an inner surface defining a shaft aperture adapted for the shaft to fit therein in a complementary manner and also defining opposing first and second rims which bound the outer surface, the inner surface further including friction means for releasibly adhering to the shaft of the golf club wherein the friction means is secured to the inner surface.

2. The counterweight apparatus of claim 1 in combination with a golf club having a shaft.

3. The counterweight apparatus of claim 2 wherein the golf club is a putter.

4. The counterweight apparatus of claim 2 wherein the shaft includes indicia for indicating the location of the counterweight apparatus upon the shaft.

5. The counterweight apparatus of claim 1 including at least one slot on the inner surface wherein the friction means are located.

6. The counterweight apparatus of claim 5 wherein the friction means comprises at least one ring having material with a coefficient of friction higher than that of the weight member.

7. The counterweight apparatus of claim 6 wherein the ring is split.

8. The counterweight apparatus of claim 1 wherein the friction means comprise a ring including a ring aperture adapted to fit the shaft closely therein, the ring being attached to the inner surface with the ring aperture located substantially coincident to the shaft aperture.

9. The counterweight apparatus of claim 1 wherein the weight member comprises a first member section and a second member section, wherein each member section includes fixture means for releasibly attaching the first member section to the second member section.

10. The counterweight apparatus of claim 9 wherein the fixture means comprises complementary threading on each of the first member section and the second member section.

11. The counterweight apparatus of claim 10 wherein the threading on the first member section exerts a compressive force upon the second member section, thereby compressing the friction means.

12. The counterweight apparatus of claim 1 wherein at least a portion of the outer surface includes knurling.

13. The counterweight apparatus of claim 1 wherein the weight member comprises a first member section and a second member section, wherein the first and second weight sections are adapted to fit in axial alignment along the shaft aperture, the weight member further comprising fixture means for releasibly attaching the first member section to the second member section.

14. The counterweight apparatus of claim 13 wherein the fixture means comprise a threaded fastener which engages an aperture located on at least one member section.

15. The counterweight apparatus of claim 13 wherein the friction means comprise two half sleeves, each resting within a slot located on the inner surface of each member section, and each having a coefficient of friction higher than its respective member section.

16. The counterweight apparatus of claim 1 wherein the weight member is made of steel.

17. A golf club and counterweight apparatus comprising:

a. a golf club including a generally rodlike shaft located between and attached to a head and a handle; and b. a weight member including an outer surface, an inner surface defining a shaft aperture adapted for the shaft to fit therein in a complementary manner, and opposing rims which bound the inner surface and the outer surface, the inner surface further including friction means for releasibly adhering the weight member to the shaft of the golf club wherein the friction means is secured to the inner surface.

18. The counterweight apparatus of claim 17 wherein the weight member comprises a first member section and a second member section, wherein each member section includes fixture means for releasibly attaching the first member section to the second member section.

19. The counterweight apparatus of claim 18 wherein the fixture means comprise threading on the first member section which engages a complementary aperture located on the second member section.

20. The counterweight apparatus of claim 18 wherein the friction means comprise a ring having material with a coefficient of friction higher than that of at least one of the first member section and the second member section.

21. The counterweight apparatus of claim 18 wherein the friction means comprise first and second split sleeves, with the first split sleeve resting within a first slot located on the inner surface of the first member section and the second split sleeve resting within a second slot located on the inner surface of the second member section, with each of the first and second split sleeves having a coefficient of friction higher than its respective first and second member sections.

22. The counterweight apparatus of claim 18 wherein the first member section is made of a heavy material and the second member section is made of a material having a high coefficient of friction.

* * * * *